US006309236B1

(12) United States Patent
Ullrich

(10) Patent No.: US 6,309,236 B1
(45) Date of Patent: Oct. 30, 2001

(54) REFLECTOR LAMP UNIT OF A BILATERALLY BASED DISCHARGE LAMP AND LAMP HOLDER

(75) Inventor: Bernd Ullrich, Erlensee (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 09/526,493

(22) Filed: Mar. 15, 2000

(30) Foreign Application Priority Data

Mar. 17, 1999 (DE) ..... 199 12 032

(51) Int. Cl.[7] ..... H01R 33/02
(52) U.S. Cl. ..... 439/226
(58) Field of Search ..... 439/226, 239, 439/680, 677, 241, 830, 831

(56) References Cited

U.S. PATENT DOCUMENTS 2,943,295 * 6/1960 Stewart ..... 439/258
3,944,808 3/1976 Vause .
4,084,873 4/1978 Grate .
4,713,019 12/1987 Gaynor .
5,357,171 10/1994 Waldhauer .

FOREIGN PATENT DOCUMENTS 39 34 348 C2 9/1993 (DE) .

* cited by examiner

*Primary Examiner*—Gary Paumen
*Assistant Examiner*—Phuong Nguyen
(74) *Attorney, Agent, or Firm*—Oblon, Spivak, McClelland, Maier & Neustadt, P.C.

(57) ABSTRACT

A reflector lamp unit with a bilaterally based discharge lamp is provided wherein at least one terminal post of the lamp has, in the area of at least one predetermined coding site as viewed in a plug-in direction, a tapered portion which, as viewed in the direction of the longitudinal axis of the bulb, has a specified tapered length and which, as viewed in the direction parallel to the longitudinal axis, has a specified lateral residual width. The unit has at least one mounting element which is closed off with a coding element which has, in the area of the coding site, a coding slot open in the plug-in direction and running in the direction of the longitudinal axis of the bulb, which corresponds to the tapered portion of the terminal post such that the slot length is shorter than the length of the tapered portion, and the slot has a minimal slot width which is adjusted so as to have a value between the lateral pin width and the residual width.

6 Claims, 1 Drawing Sheet

REFLECTOR LAMP UNIT OF A BILATERALLY BASED DISCHARGE LAMP AND LAMP HOLDER

BACKGROUND OF THE INVENTION

1. Field of the Invention

The present invention concerns a reflector lamp unit of a bilaterally based discharge lamp and lamp holder whereby the reflector lamp has a lamp bulb which is closed off enclosing two electrodes lying opposite each other in the direction of the long bulb axis on its front side ends by means of crimping members from which in each case a lead-in bushing is passed out for electrical contacting of the electrodes and is connected to a terminal post, whereby each crimping member is surrounded at least partially by a base of an electrically insulated material through which the free end of the respective terminal post extends, and engages into the holder in which the discharge lamp is insertable in a plug-in direction running perpendicular to the longitudinal axis of the bulb, whereby the holder has a first and a second mounting element for accommodating the terminal posts which is provided with a contact element of electrically conducting material on which the respective terminal post lies.

2. Discussion of the Background

A reflector lamp unit with a bilaterally based discharge lamp and lamp holder is known from DE-A 39 34 348, With the discharge lamp described therein, two electrodes lie within a tube-like quartz glass bulb opposite the longitudinal axis of the bulb which are connected to an external power supply conductor through a sheet of metal crimped in the bulb end. The power supply conductors include a contact pin of nickel, brass, copper or a nickel base alloy with a specified outside diameter. The contact pins extend through a base casing of aluminum oxide ceramic or of plastic whereby they are arranged on, a common axis. The holder for a discharge lamp includes a left and a right mounting element which is arranged on both sides of the discharge lamp and contains a metal contact spring in which the free end of tile respective contact pin is clamped.

Such reflector lamp units are used, for example, in an application such as UV reflector lamps in the area of cosmetics for the purpose of tanning, or in the medical area for therapeutic treatment of diseased skin areas.

Health problems can result from confusing various types of lamps and performance classes, and with technical applications, costly consequences result from faulty manufacturing processes. In order to avoid such confusions, it is proposed in DE-A 41 33 614 to admix to the gas mixture contained in the lamp bulb a characteristic radiation emitting substance whose emission spectrum can be established by a detector. The detector does not, however, recognize such unsuitable lamp types and performance classes where the characteristic emission spectrum is present. In U.S. Pat. No. 4,713,019, providing the base of a discharge lamp with projections which correspond to slots in the holder is proposed. Here it proves to be problematic that bases without projections of this type also fit into this holder, so that even with this proposed solution, confusion cannot be ruled out.

SUMMARY OF THE INVENTION

An object of the invention is therefore to perfect a reflector lamp with a bilaterally based discharge lamp such that the confusion characterized in the known lamps can be ruled out with a high degree of certainty.

This objective is accomplished on the basis of a reflector lamp unit wherein at least one of the terminal posts has, in the region of at least one predetermined coding site viewed in the plug-in direction, a slotted or tapered portion of its lateral pin width with (as viewed in the direction of the lamp longitudinal axis) a specified tapered length and (as viewed in a direction perpendicular to such axis) a specified lateral residual width, and wherein at least one of the mounting elements is closed off with a coding element which has, in the region of the coding site, a coding slot open in the plug-in direction and running in the direction of the lamp longitudinal axis which corresponds to the tapered portion of the terminal post such that the slot length thereof is shorter than the tapered length, and such that it has a minimal slot width which is adjusted to a value which is between the lateral pin width and the residual width.

The bilaterally based discharge lamp is inserted into the bilateral mounting elements of the holder in the plug-in direction, thus in a direction perpendicular to the lamp longitudinal axis. With the reflector lamp of the invention, at least one of the mounting elements is closed off with a coding element. The coding element is for preventing insertion of an unsuitable discharge lamp into the holder. For this purpose, the coding element has a coding slot which corresponds to the cross sectional tapered portion of the terminal post of the discharge lamp in the manner of a look and key. The tapered portion of the terminal post in the region of the coding site can, for example, be constructed as a rectangular groove, a V-shaped groove or as a concave internal arch. It is essential that the cross section of the terminal post be appropriately tapered as viewed in the plug-in direction. The cross sectional tapered portion results in a residual width of the terminal post which is smaller than the width of the coding slot so that the coded terminal post can fit the coding element and can be inserted into the mounting element. Only in this manner can electrical contact be produced with the contact element. Terminal posts which lack the appropriate "coding" can neither be inserted into the holder nor can an electrical contact be set up with the contact element within a mounting element of the holder.

So that the terminal post can be introduced in the plug-in direction, it is necessary that the coding slot be open in the insertion direction and that it run in the direction of the lamp longitudinal axis. The coding slot has a minimal slot width which is adjusted to a value in the region between the lateral width of the terminal post and the residual breadth in the region of tapering. Viewed in the plug-in direction, the slot width of the coding slot can be constant. Otherwise, the minimal slot width exists in an upper area of the coding slot, whereby the slot breadth of the coding slot can be greater in a lower lying, lower region, as viewed in the plug-in direction.

A reflector lamp unit is preferred in which at least one terminal post has several coding sites which correspond to one or several coding elements. Several coding sites permit a greater number of variations of coding, thus make possible a finer classification of unsuitable discharge lamps and consequently increased safety in relation to the use of unsuitable discharge lamps. The respective coding sites can be provided on a common side of the respective terminal post or on inherently opposite sides.

In this respect, it has also been demonstrated that both terminal posts have at least one coding site and that the front and the second mounting elements are closed off with an appropriate coding element which has a coding slot in the area of the respective coding site.

One embodiment of the reflective lamp unit has proven suitable in connection with which the tapered portion is constructed as a circular groove. Such a circular groove is especially easily producible with a terminal post with a round cross section.

In an alternative and equally suitable embodiment, the tapered portion is constructed as a long slot running in the plug-in direction. Such a slot is especially to be preferred in connection with a terminal post with rectangular cross section.

An embodiment of the reflector lamp unit of the invention has proved particularly effective in connection with which the tapering is constructed as a groove with a shallow bottom region, and whereby the coding slot (as viewed in the plug-in direction) has an expansion region below an area with minimal slot width the opening breadth of which is at least as large as the diameter which an envelope describes around the cross section (as viewed in the direction of the lamp long axis) of the terminal post in the region of the coding site, and whereby the coding slot has a flat side which corresponds to the bottom area. With this embodiment, a mechanical catch is provided for the terminal post. The terminal post can, insofar as it has the appropriate coding, be inserted into the coding slot and subsequently be rotated about its long axis until the shallow bottom area of the groove lies on the flat side of the coding slot. In this manner, maintenance of a specified orientation of the discharge lamp toward the holder is facilitated. The expansion area moreover permits rotating the terminal post about the longitudinal axis of the bulb.

Advantageously, the contact element is constructed as a spring element surrounding the respective terminal post. In this manner, a secure support of the terminal post in the holder is guaranteed.

A coding element which is constructed in the shape of a coding sheet has proven especially advantageous. Such a coding sheet can be manufactured with little expense. The coding sheet is, moreover, installed in the mounting element such that at least one flat side runs perpendicular to the longitudinal axis of the lamp. The slot length of the coding slot corresponds to the sheet thickness in the particular case.

Advantageously, the coding slot has a median line which runs parallel to the plug-in direction and is laterally staggered in relation to the lamp longitudinal axis. Owing to the eccentric arrangement of the coding slot outside the plane defined by the plug-in direction and the longitudinal axis of the lamp, there results a greater number of variations of possible codings.

BRIEF DESCRIPTION OF THE DRAWINGS

Various other objects, features and attendant advantages of the present invention will be more fully appreciated as the same becomes better understood from the following detailed description when considered in connection with the accompanying drawing wherein.

DESCRIPTION OF THE PREFERRED EMBODIMENT

Figure 1:
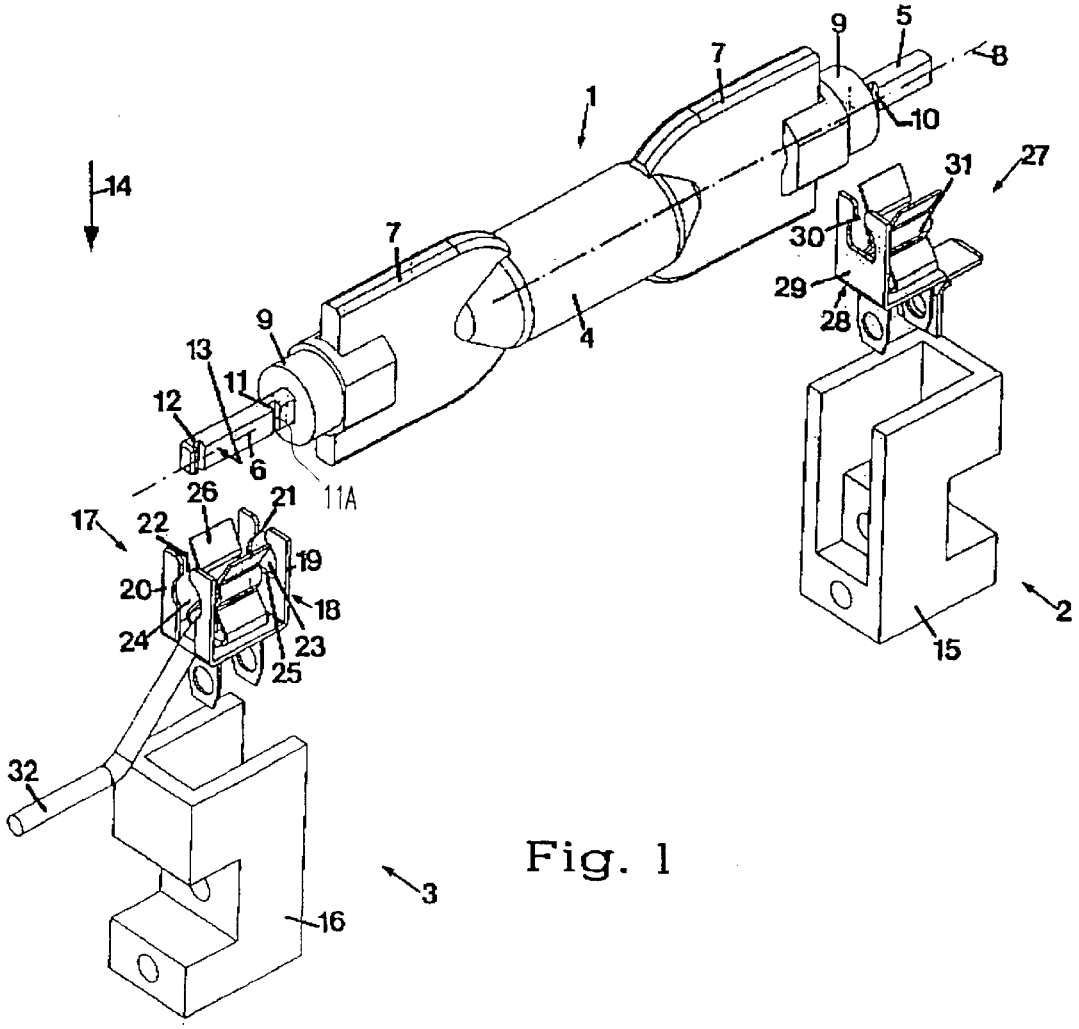
FIG. 1: shows an exploded view of an embodiment of a reflector lamp unit of the invention in a perspective view.

The reflector lamp unit represented in FIG. 1 consists of a discharge lamp 1 and a holder with a right mounting element 2 and a left mounting element 3. The discharge lamp 1 has a tube-shaped quartz glass bulb 4 which includes electrodes 7*a*. The electrodes 7*a* are in any given case joined with another power supply conductor in the form of a terminal post or metal contact pins 5, 6 through a metal sheet 7*b* crimped in the lamp end. These crimped members are in each case surrounded by a protective casing 7. The contact pins 5, 6 which extend on both sides of the quartz glass lamp 4 in the longitudinal axis 8 thereof in any given case through a ceramic base 9 have a rectangular profile. Their height-measurement parallel to the plug-in direction which is indicated in FIG. 1 with the direction arrow 14 is 4 mm and the lateral pin width in each case is 3 mm. The contact pin 5 extending to the right in the Figure is provided with a penetrating rectangular groove 10 and the contact pin 6 extending to the left is provided with two parallel penetrating rectangular grooves 11, 12 running parallel to each other. All rectangular grooves 10, 11, 12 extend in the plug-in direction 14 and have a depth of 1 mm and a width (as viewed in the direction of the long axis 8) of 1 mm, whereby the bottom of the groove is in any given case constructed flat. The lateral residual width of the contact pins 5, 6 in the region of the rectangular grooves 10, 11, 12 consequently is 2 mm. The two rectangular grooves 11, 12 are constructed on the same side 13 of contact pin 6, whereby their distance apart from each other is up to 10 mm. A circular groove 11*a*, as used in cross-section can also be utilized, for example.

The mounting elements 2, 3 consist of one housing element 15, 16, each of aluminum oxide ceramics, which have a hollow space for accommodation of an insert 17, 27. The insert 17 consists of a coding sheet 18 having bent U-shaped free legs 19, 20 of which project in the direction opposite the plug-in direction 14 and which are provided with a coding slot 21, 22 opened upwardly. The distance between the two coding slots 21, 22 is 10 mm, corresponding to the distance between the two rectangular grooves 11, 12. The minimal slot width of the two coding slots 21, 22 is constructed in the upper region and is equal to 2.2 mm. Below this (as viewed in the plug-in direction 14) there is provided an expanded portion 23, 24 of the coding slots 21, 22 each with a diameter of about 5 mm, whereby the coding slot expansion 24 facing the discharge lamp 1 has a flat side 25 in the bottom area thereof. In the area enclosed by the two legs 19, 20, a metal contact spring 26 is attached which is connected with a terminal lug 32. The coding slot has a median line which runs parallel to the direction of the at least one terminal post and which is axially staggered in rotation to the longitudinal axis of the bulb.

The insert 27 lying opposite insert 17 consists of a coding sheet 28 bent at right angles from which the one leg 29 projects in the direction against the plug-in direction 14 and is provided with an upwardly opened coding slot 30 corresponding in shape and dimension with coding slot 21. The insert 27 is likewise provided with a metal contact spring 31.

With a completed installed holder 2, the distances of the coding slots 21, 22, 30 from one another respectively correspond exactly to the distances between the rectangular grooves 10, 11, 12 of the contact pins 5, 6. In addition, the minimal slot width of the coding slots of 2.2 mm allows insertion of the discharge lamp 1 in the orientation represented in FIG. 1, thus with rectangular grooves running parallel to the plug-in direction 14. The coding slots 21, 22, 30 thus form a coding assembly which only permits the use of such a discharge lamp into the holder 2, 3 which has the corresponding coding on the side of the contact pins as represented in FIG. 1. After installing the discharge lamp 1, the lamp is rotated by 90° about its longitudinal axis 8 so that the bottom of the rectangular groove 11 catches on the flat side 25 of the coding slot expansion 23. In this manner, an exact positioning of the discharge lamp in the holder 2, 3 is guaranteed. In this position, the contact pins 5, 6 are firmly contacted areawise by the spring force of the contact springs 26, 31.

Obviously, numerous modifications and variations of the present invention are possible in light of the above teachings. It is therefore to be understood that within the scope of the appended claims, the invention may be practiced otherwise than as specifically described herein.

What is claimed is:

1. A reflector lamp unit for a bilaterally based discharge lamp having a lamp bulb, which comprises:

a lamp holder;

first and second terminal posts wherein the discharge lamp has a lamp bulb which is closed off in the direction of the longitudinal axis of the bulb for enclosing electrodes therein lying opposite one another and being electrically connected with said terminal posts;

the holder including first and second mounting elements for respectively accommodating the terminal posts; and at least one coding element wherein at least one of the terminal posts has a slotted portion of a predetermined length and a predetermined lateral residual width, said at least one coding element having a coding slot open in a direction of insertion of the terminal posts wherein said coding slot has a width of a value substantially between the width of at least one of said terminal posts and the lateral residual width of the slotted portion of said at least one of said terminal posts;

said at least one terminal post having said at least one coding member and is positioned in one of said first and second mounting elements;

wherein the coding member comprises said coding slot which has a median line which runs parallel to the direction of the insertion of said at least one terminal post.

2. A reflector lamp unit according to claim 1, wherein the at least one terminal post is engageable with a plurality of coding members which correspond with said at least one coding element.

3. A reflector lamp unit according to claim 1, wherein the slotted portion of the electronic terminal post of said predetermined length and width comprises a longitudinal slot extending in the direction of insertion of said at least one terminal post.

4. A reflector lamp according to claim 1, wherein the slotted portion comprises a circular grooved portion.

5. A reflector lamp unit according to claim 1, wherein the slotted portion comprises a groove having a shallow bottom area, the coding slot having an enlarged opening with the width thereof being at least as large as a diameter of a cross-section of the terminal post and wherein the coding slot has a flat sided portion positionable in proximity with said bottom area.

6. A reflector lamp unit according to claim 1, wherein at least one of said first and second terminal posts comprises a contact element having a spring element for surrounding said at least one terminal post.

* * * * *